United States Patent [19]

Moss

[11] Patent Number: 4,645,203

[45] Date of Patent: Feb. 24, 1987

[54] PORTABLE FOREARM DEVELOPER

[76] Inventor: Arthur Moss, 30763 Tamarack, Wixom, Mich. 48096

[21] Appl. No.: 486,563

[22] Filed: Apr. 20, 1983

[51] Int. Cl.[4] ..... A63B 21/00

[52] U.S. Cl. ..... 272/117; 272/67; 272/900

[58] Field of Search ..... 272/67, 93, 68, 117, 272/140, 142, 900, 143

[56] References Cited

U.S. PATENT DOCUMENTS

| | | | |
|---|---|---|---|
| 74,683 | 2/1868 | Hall | 272/61 |
| D. 264,237 | 5/1982 | McCaleb et al. | 272/67 X |
| 402,495 | 4/1889 | Vaidis | 272/61 |
| 1,012,212 | 12/1911 | Mells | 272/61 |
| 1,646,158 | 10/1927 | McWhirter | 272/61 |
| 3,189,347 | 6/1965 | Dodge | 272/117 |
| 3,233,894 | 2/1966 | Binan | 272/61 |
| 4,072,308 | 2/1978 | Applegate | 272/67 X |
| 4,257,590 | 3/1981 | Sullivan et al. | 272/117 |
| 4,290,598 | 9/1981 | Flannery | 272/117 |
| 4,373,717 | 2/1983 | Lambert | 272/67 |
| 4,477,073 | 10/1984 | Koch et al. | 272/73 |

FOREIGN PATENT DOCUMENTS

| | | | |
|---|---|---|---|
| 738579 | 12/1932 | France | 272/117 |
| 138469 | 2/1920 | United Kingdom | 272/117 |

*Primary Examiner*—Richard J. Apley
*Assistant Examiner*—Robert W. Bahr
*Attorney, Agent, or Firm*—Burton, Parker & Schramm

[57] ABSTRACT

A forearm developer having a cylindrical handle with a rope suspended from its center for attachment to a weight to raise same by twistingly rotating the handle. The handle is supported by a suspended frame having two depending parallel spaced apart support loops into which the opposing ends of the handle are placed for rotatable support.

4 Claims, 2 Drawing Figures

PORTABLE FOREARM DEVELOPER

FIELD OF THE INVENTION

This invention relates to an exercising device for forearm development, and more particularly to a portable forearm developer.

BACKGROUND OF THE INVENTION

Most exercises tend to develop a large number of muscle groups so that those muscles can better perform that exercise in the future. However, sometimes certain muscles need to be developed further for asthetic reasons or because those muscles may be needed for other purposes. In such instances, exercises which predominately develop only those selected muscles have been desired. Other times, selective exercises have been used to exercise certain selected muscles in order to avoid stressing other parts of the body. For example, a person with a back injury may want to engage in exercises that develop his forearms without placing stress on his back.

U.S. Pat. No. 3,982,755 teaches a specially shaped cylindrical rod having two inverted, tapered, generally cone-shaped sections joined together at their narrowest sections, generally in the middle of the rod, about which a rope may be wrapped with the free end of the rope attached to a weight. By standing erect and holding the rod in both hands, a person can raise or lower the weight by twisting the rod to wind the rope onto the cylinder. According to this patent, this device is "designed to deepen the chest, broaden the waist and reduce the waistline of the user." Definitely, such a device would utilize the arm, shoulder, back and abdominal muscles without selectively exercising any one of them.

SUMMARY

I have found that I can take a handle, preferrably in the form of a cylindrical rod, with a right and a left hand position, attach one end of a rope to the handle near its center intermediate these hand positions, and attach the other end of the rope to a weight to exercise predominately the forearm muscles by rotating the handle towards or away from the user for winding the rope thereon to raise the weight or by rotating the handle in the opposite direction for unwinding the rope therefrom to lower the weight. This can be accomplished with minimal chest, back or abdominal involvement, for those with injuries in those areas or for those who have a special need to concentrate on forearm development. I have accomplished this by placing the handle in a suspended frame which supports the handle for rotation, so that no effort on the part of the user is needed to keep the handle suspended.

Preferrably, the frame has a base to which two spaced apart loops of cord are attached. One end of the handle is placed into one loop and the other end in the corresponding loop to thereby support the handle for rotation.

Preferably a circular track circumscribes each handle, outboard of the hand positions to be placed in matable registration with the corresponding material of the loop for holding the loop in position as the handle is rotated thereon by the user's twisting hands.

DESCRIPTION OF THE PREFERRED EMBODIMENTS

A more detailed understanding of the invention can be obtained by looking at the preferred embodiments.

Figure 1:
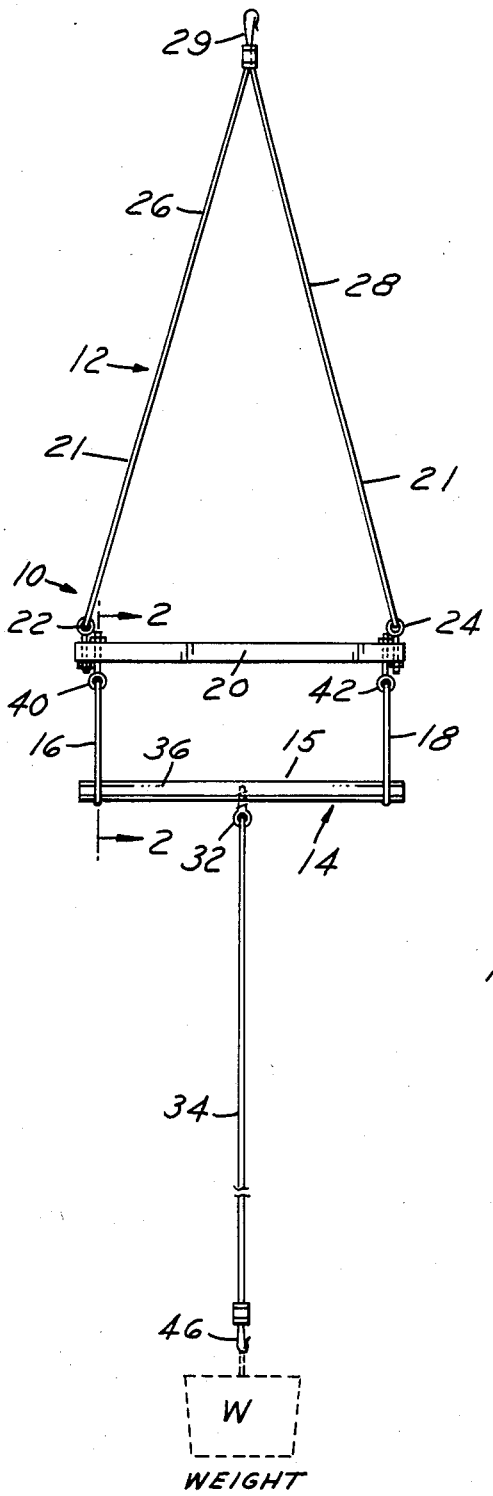
FIG. 1 is a frontal view on an embodiment of the invention.

FIG. 1 depicts an embodiment of the forearm developer (10). The developer (10) includes a suspendable support frame (12); a weight lifter (14) having a rotatable handle (15); a first loop (16) and a second loop (18) depending from the frame (12) into which loops corresponding ends of the handle (15) are positioned for supporting the weight lifter (14).

In a preferred embodiment, the frame (12) has a base (20), that is a rigid member made of wood or other material suitable for supporting the lifting of weights.

The base (20) is attached to sides (21) from which it depends from connectors such as a first eyebolt (22) and a second eyebolt (24) which are preferably aligned on the same side and near opposite ends of the base (20). For the preferred construction depicted, one end of a cord is attached at the first eyebolt (22) and the other end at the second eyebolt (24). The cord is pulled taut at its center and thus, a triangular support frame is formed with the cord forming a first side (26) and a second side (28), preferrably of equal length, with the base (20) forming the base of the triangle. A support frame hook (29) may be attached to the apex of the triangle for suspending the frame (18) from an overhead support (not shown) such as a ceiling hook.

Although the above described triangular shaped construction is preferred, other forms such as a rectangle (not shown) could also be used. A rectangle could be constructed using two separate cords of equal length, one attached at one end to the first eyebolt (22) and the second cord attached at an end to the other eyebolt (24) with the free ends of each cord being attachable to an overhead support.

The sides (21) such as the first side (26) and the second side (28) are preferably made from a flexible material such as a rope or wire, as this flexibility makes it easy to store the frame (12) in a very small space and allows the frame limited free movement in the horizontal plane relative to the overhead support. However, rigid materials can be used.

The weight lifter (14) has a handle (15). The handle (15) preferably has a center eye screw (32) to which one end of a rope for supporting weights (34), such as a cord or wire is attached. However, the center eye screw (32) may be omitted and the rope (34) attached directly to the handle (15). The other end of the rope (34) is attached to a weight.

Figure 2:
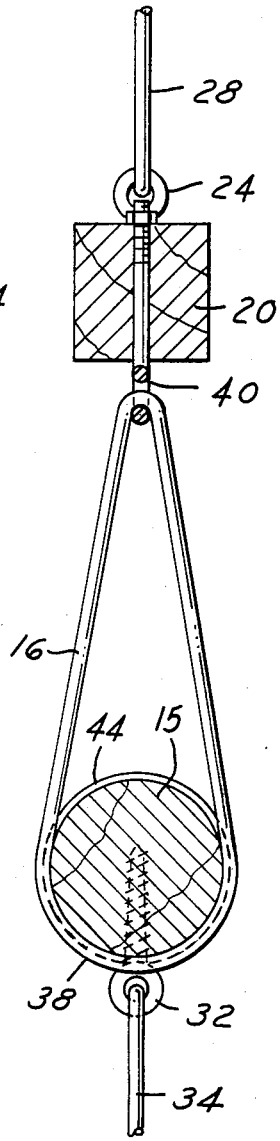
FIG. 2 is a sectional view on an embodiment shown in FIG. 1 along line 2—2.

On either side of the center eye screw (32) is a hand position (36). Outboard of each hand position (36), the handle (15) rests in the U (38) formed by the loops as shown in FIG. 2. Each loop depends from the base (20) of the frame (12). Preferably, the first loop (16) depends from a hanger, such as a third eyebolt (40) attached to the base (20) of the frame (12) allowing the handle limited free movement in the horizontal plane relative to the base. While the second loop (18) preferrably depends from a hanger, such as a fourth eyebolt (42), attached to the frame base (20). Preferrably, as shown in FIG. 2, near each of its ends the handle (15) is circumscribed by a track (44) such as a groove in the handle (15) which is larger than and in register with a corresponding loop for tracking. Preferably, each loop should be of approximately equal size and approximately parallel in order to keep the handle (15) approximately level with the base (20) of the frame (12).

The handle (15) is a dowel or other preferrably rigid cyclindrical object. The diameter of the handle is critical. The smaller the diameter, the more forearm development there will be relative to wrist development. A high forearm to wrist development ratio is desired for this device, as the purpose of the forearm developer is to develop the forearm. Wrists can be relatively easily developed merely through squeezing motions such as squeezing a rubber ball. However, if one wishes to exercise predominently the wrist or to alter the ratio of wrist to forearm development, this can be accomplished by changing the handle diameter.

The larger the handle diameter, the greater the degree of wrist development relative to the forearm. For the average adult male, a one and a quarter inch diameter dowel gives optimal forearm development. As the diameter decreases in size, forearm development may improve, but as the handle (15) becomes increasingly smaller, it becomes more difficult to achieve satisfactory grip and rotation. On the other hand, as the handle diameter increases above one and a quarter to one and a half inch diameter, more wrist development may occur relative to forearm development. At a diameter of two and a half inches, the wrist development becomes optimal. Thus, a handle (15) with a diameter of approximately one and a quarter inches is preferred for forearm development.

The handle (15) must be long enough to comfortably accomodate two hands in the hand positions which are sandwiched between the weight supporting rope (34) and the outboard loops. An approximately 18 inch long one and a quarter inch diameter wood dowel is satisfactory. This allows approximately 8 inches for each hand position.

Preferably, proximate each end, the handle (15) will be circumscribed by a substantially circular track (44). The tracks (44) should be deep enough and wide enough to accomodate the loop material to facilitate tracking of the rotating handle (15) thereon. For a weight developer (10) designed for thirty pound loads a track (44) one eighth inch wide and one sixteenth inch deep and a loop having a six inch circumference and made from a nylon cord such as by tying together the ends of a nylon clothesline would be satisfactory.

The weight supporting rope (34) can be made from the same type of nylon cord as the loops. Generally, the weight supporting rope (34) should be long enough for the weights to touch, or almost touch, the floor when the forearm developer (10) is suspended from an overhead support but not being used. For example, a 54 inch long rope would generally be satisfactory if the first side (27) and second side (28) of the triangular support frame are each 24 inches, the base (20) has a one and one quarter inch diameter, the first loop (16) and the second loop (18) each have a six inch circumference, and the handle (15) has a one and one quarter inch circumference.

The portable forearm developer (10) when suspended, should have a handle (15) at a suitable height for gripping, although any height which allows the weight to be moved will provide some benefit. Preferably, the handle (15) should be parallel to the floor and be between waist and shoulder level of the user and, most preferably, the handle (15) will be approximately shoulder height.

The weight supporting rope (34) may be tied to the weights or may have a weight hook (46) such as a swivel snap hook for securing the weights.

In operation, the hook (29) is attached to an elevated support (not shown) so that the forearm developer (10) is suspended sufficiently for the weight to be raised.

The user places a hand in each hand position (36) on the handle (15) preferably palms down and rotates the handle (15) generally by twisting his wrists or rolling the handle (15) through his fingers. Rotation in one direction winds the rope (34) onto the handle (15), causing the weight to rise; rotation in the other direction, unwinds the rope (34) from the handle (15) causing the weight to descend. The initial direction of rotation is important because when winding the weight upward:

1. Downward rotation of the wrist will put stress on the anterior or under part of the forearm.

2. Upward rotation of the wrist will put stress on the posterior or top part of the forearm.

In the preferred embodiment, the rope windings (not shown), which have approximately the same diameter as the handle, can be kept close to the center of the handle (15) by moving the handle (15) slightly towards one hand or another to cause the rope to stay in the center. Movements of less than one inch one way or the other will generally suffice.

What is claimed is:

1. A weight lifting device for forearm development comprising, in combination:

a rotatable handle having two ends and a length sufficient to accommodate two hands, said handle being further provided with a circumscribed groove adjacent each end;

an elongated rigid horizontal frame member having two ends;

two flexible, isometric sidewalls, each having two ends, one for attachment to an overhead support and the other end for attachment to the frame for freely suspending the frame from the overhead support;

a pair of spaced apart elongated loop cords for rotatably suspending the handle from the frame, the cords being supported at the upper end by the frame, the lower ends of the loops having a U-shape into which the circumscribed grooves in the handle are correspondingly placed for support; and means for suspending a weight from the handle, said means for suspending a weight being attachable to the handle and the weight and wound about the handle as the handle is rotatable by user.

2. A forearm development device for lifting a weight, comprising a horizontal frame;

two flexible side members each having a first and second end, the first end of each attached to opposite ends of said frame;

means for attaching the second ends of the flexible side members to an overhead support for the free suspension of the frame therefrom while allowing limited free horizontal movement of the relative to the support;

a rotatable cylindrical handle having two ends, a length sufficient to accommodate two hands, and a circumscribed groove adjacent each of its ends;

means for coupling the handle to a weight to raise and lower said weight in response to handle rotation; and two U-shaped loops of cord each attached at the upper end to then frame and cooperating with the circumscribed grooves in said handle for horizontally suspending the handle and the weight coupled thereto from the frame while allowing free rotation and limited free horizontal movement of the handle relative to the frame;

wherein said forearm development device may be detached from the weight and overhead support and collapsed into a small, light, compact unit for storage.

3. A forearm development device for lifting a weight, comprising a horizontal frame;

means for suspending the frame from an overhead support while allowing limited free horizontal movement of the handle relative to the support wherein the means for suspending the frame further comprises: two flexible side members each having a first and second end, the first end of each attached to opposite ends of said frame; and means for attaching the second ends of the flexible side members to an overhead support for the free suspension of the frame therefrom;

a rotatable cylindrical handle having two ends and a length sufficient to accommodate two hands;

means for coupling the handle to a weight to raise and lower said weight in response to handle rotation; and means for horizontally suspending the handle and the weight coupled thereto from the frame while allowing free rotation and limited free horizontal movement of the handle releative to the frame;

wherein said forearm development device may be detached from the weight and overhead support and collapsed into a small, light, compact unit for storage.

4. The device of claim 3 wherein:

the handle is provided with circumscribed grooves adjacent each of its ends; and said means for horizontally suspending the handle from the frame comprises two U-shaped loops of cord supported at the upper end by the frame and cooperating with the circumscribed grooves in said handle for supporting same.

* * * * *

UNITED STATES PATENT AND TRADEMARK OFFICE

CERTIFICATE OF CORRECTION

PATENT NO. : 4,645,203

DATED : February 24, 1987

INVENTOR(S) : Arthur Moss

It is certified that error appears in the above-identified patent and that said Letters Patent is hereby corrected as shown below:

In Claim 2, Column 4, Line 61, please delete the phrase "of the" and insert in its place the word ---thereof---.

In Claim 3, Column 6, Line 11, please delete the word "releative" and insert in its place the word ---relative---.

Signed and Sealed this

Twenty-third Day of February, 1988

*Attest:*

DONALD J. QUIGG

*Attesting Officer*

*Commissioner of Patents and Trademarks*